US006361393B1

(12) United States Patent
Seymour

(10) Patent No.: US 6,361,393 B1
(45) Date of Patent: Mar. 26, 2002

(54) MAGNETIC IMPULSE REACTION DRIVEN TOYS

(75) Inventor: Arthur F. Seymour, Deerfield, IL (US)

(73) Assignee: Elenco Electronics, Inc., Wheeling, IL (US)

( * ) Notice: Subject to any disclaimer, the term of this patent is extended or adjusted under 35 U.S.C. 154(b) by 0 days.

(21) Appl. No.: 09/169,234

(22) Filed: Oct. 9, 1998

(51) Int. Cl.[7] ..... A63H 27/00

(52) U.S. Cl. ..... 446/34; 446/129; 446/429

(58) Field of Search ..... 446/7, 34, 129, 446/130, 131, 132, 133, 134, 135, 136, 219, 231, 396, 398, 399, 400, 405, 429, 430; 74/DIG. 9

(56) References Cited

U.S. PATENT DOCUMENTS

| | | | | | |
|---|---|---|---|---|---|
| 3,196,566 | A | * | 7/1965 | Littlefield | 446/129 X |
| 3,908,306 | A | * | 9/1975 | Petersen et al. | 446/399 X |
| 3,964,746 | A | * | 6/1976 | MacMurdo | 446/132 X |
| 4,074,153 | A | | 2/1978 | Baker et al. | 310/12 |
| 4,709,883 | A | | 12/1987 | Giuliani et al. | 244/63 |
| 4,796,511 | A | | 1/1989 | Eyssa | 89/8 |
| 4,817,494 | A | | 4/1989 | Cowan | 89/8 |
| 4,861,308 | A | * | 8/1989 | Kakizaki | 446/129 |
| 5,141,467 | A | * | 8/1992 | Crosbie et al. | 446/398 |
| 5,188,555 | A | * | 2/1993 | Zbegner | 446/129 X |
| 5,402,021 | A | | 3/1995 | Johnson | 310/12 |
| 5,458,043 | A | | 10/1995 | Jensen et al. | 89/8 |
| 5,506,459 | A | * | 4/1996 | Ritts | 446/256 X |
| 5,674,104 | A | * | 10/1997 | Ohashi et al. | 446/131 X |
| 5,974,977 | A | * | 11/1999 | Johnson et al. | 446/133 |
| 6,109,123 | A | * | 8/2000 | Baskis et al. | 74/DIG. 9 |

* cited by examiner

*Primary Examiner*—Sam Rimell
(74) *Attorney, Agent, or Firm*—Welsh & Katz, Ltd.; Thomas W. Tolpin

(57) ABSTRACT

Enjoyable propulsion toys can be readily propelled by special magnetic impulse reaction systems. The toys include attractive resilient projectiles which are constructed of foam rubber in order to be safe for children. The projectiles are propelled from base units which contain circuitry for the magnetic impulse reaction systems. Preferably, the circuitry includes a flash tube for emitting a flash of light when the projectile is propelled. Desirably, the circuitry also includes an acoustical generator to generate propulsion sounds when the projectile is propelled. The projectile can be in the form of a: toy rocket, toy airplane, toy glider, toy wheeled vehicle, or toy bullet.

21 Claims, 7 Drawing Sheets

Fig. 6
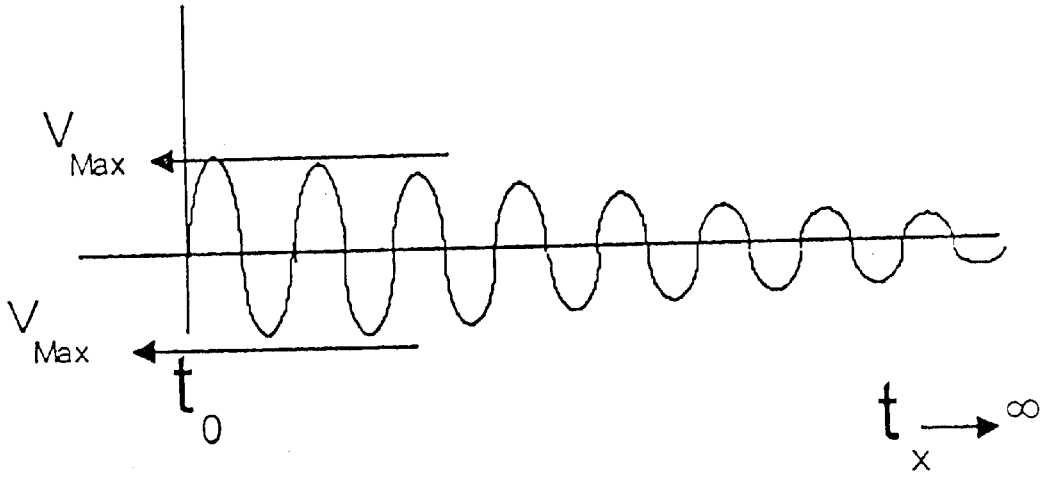
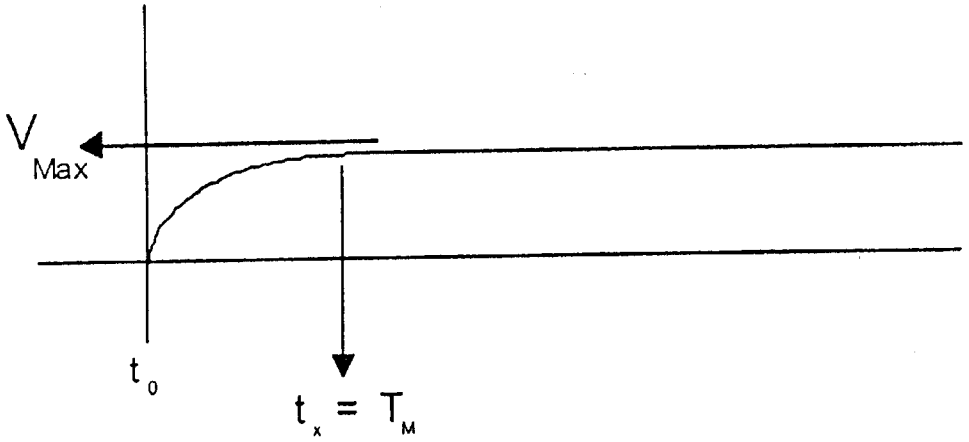
Fig. 7

MAGNETIC IMPULSE REACTION DRIVEN TOYS

BACKGROUND OF THE INVENTION

This invention relates to toys and, more particularly, to movable and propelled toys.

Over the years, numerous toy rockets, toy aircraft and toy vehicles have been developed, which have met with varying degrees of success. Many types of firecrackers and rockets with ignition wicks have been launched for firework displays and on other occasions. Firecrackers and ignition rockets are often propelled with combustible chemicals which create an intense exothermic reaction upon ignition that generate flames and a great amount of heat. Combustible fuels provide propulsion by the rapid expansion of flammable fuel as the fuel is burned at elevated temperatures. Such firecrackers and ignition rockets can cause explosion and fires which can be dangerous for the people launching the firecrackers and rockets, as well as injure spectators. Furthermore, such firecrackers and rockets can cause fires in trees, shrubbery, lawns, homes, and other buildings. Some toy rockets have been propelled by compressed gas, such as with carbon dioxide ($CO_2$) cartridges. Rockets propelled by compressed gas can also be very dangerous, puncture objects, and harm people. Toy rockets can also be propelled by compression springs but usually do not go very high. Springs in toy rockets are usually mechanically set and triggered through a mechanical release mechanism. Spring-driven rockets, however, can cause eye injuries and be very dangerous.

Toy airplanes have been made of balsa wood and plastic. Some toy airplanes have plastic propellers which are attached to a rubber band. The rubber band can be wound by manually turning and rotating the propeller. When the rubber band is wound, the airplane can be released to fly. Toy airplanes have also been powered by internal combustion engines by using flammable fuel such as gasoline or oil. These fuels can cause fires and explosions when not properly handled, and emit noxious vapors. These toy airplanes are often remotely controlled and can be very dangerous if not operated by skilled people.

Toy gliders have been built of balsa wood. Toy gliders are typically launched with a sling shot, catapult or rubber band.

Toy vehicles have been constructed of metal and plastic. Some toy fire engines have free spinning wheels which can be manually pushed by children. Spring-loaded toy cars can be propelled after the coiled springs are wound and released. Battery driven electric cars are also available for children. Some battery driven cars can be operated by remote control. Many toy vehicles can damage furniture and injure children if not properly handled.

It is, therefore, desirable to provide improved propulsion toys, such as toy rockets, aircraft and vehicles, which overcome many, if not most, of the preceding problems.

SUMMARY OF THE INVENTION

Improved propulsion toys are provided which are safe, reliable, and fun. Advantageously, the child-friendly toys are easy-to-use, sturdy, and economical. Desirably, the attractive toys can be readily propelled for impressive distances and have great appeal for both children and adults.

The novel toys each have a base unit comprising an electromagnetic coil and a circuit to energize the coil. Desirably, the coil cooperates with the circuit to provide a magnetic impulse reaction system or engine. The circuit can include a capacitor connected in parallel to the coil. In the preferred form, the coil comprises only a single induction coil.

The novel toys also feature a projectile comprising propulsion device which is electromagnetically propelled by and away from the coil of the base unit. For protection of children and onlookers, the propulsion device preferably has an elastomeric body with a resilient nose. The projectile preferably has a magnetically attractable propellant. In the illustrated embodiments, the magnetically attractable propellant is movable and positioned within a propulsion tube of the projectile.

Advantageously, the propulsion devices can take the form of a toy rocket, a toy airplane, a toy glider, a wheeled vehicle toy, e.g. a toy automobile (car) or a toy sports utility vehicle, or a toy bullet for use with a toy gun. The resilient rounded nose of the propulsion device can be rounded and convex and is preferably made of sponge rubber, foam rubber, or foam rubber-like plastic, to provide a cushion which absorbs impact forces and is soft so as to be completely safe for children, as well as spectators.

A preferred base unit of the novel toys comprise a visual signaling device which is operatively associated with the circuit to emit a light when the propulsion device is being propelled by the coil. In the preferred embodiments, the visual signaling device comprises a flash tube which is connected in series with the inductive coil of the magnetic impulse reaction circuit. Preferably, the flash tube and inductive coil are placed in parallel with a capacitor or charge storage device capable of providing a large current for a very short period of time. When the flash tube is triggered, the stored charges are quickly dissipated through the flash tube and the inductive coil. This action produces a very short, but highly intense magnetic field or magnetic impulse(s), along with a simultaneous flash of light. The magnetic impulse(s) acts upon the movable magnetically attractable propellant (magnetic material) inside the propulsion tube in a manner similar to a magnetic field acting upon the bar in a solenoid, to draw the magnetic material through the coil. The magnetic field of the coil quickly disappears, and dissipates, but the movable magnetically attractable propellant (magnetic material) in the compulsion tube is drawn through the coil and propelled to the body of the propulsion device with sufficient momentum and force to propel the projectile away from the coil of the base unit. Since the amount and direction of acceleration and propulsion of the projectile depends upon the strength of the magnetic field and the amount of time it is applied to the magnetically attractable propellant (magnetic material), the propulsion force and acceleration can be controlled by the circuit.

The electromagnetic impulse reaction system can provide propulsion by storing the energy in capacitors at an elevated voltage. Triggering can be electronic and does not require the use of mechanical devices. Electronic safety devices can also be used to prevent false triggering.

Propulsion can be achieved by very rapidly releasing the stored charge in the capacitors through a flash tube and an inductive coil. The rapid discharge produces a magnetic impulse(s) that propels the magnetically attractable propellant (magnetic material) in the propulsion tube through the center of the coil. If the coil is securely held stationary and not allowed to move, the projectile will receive the maximum force when the magnetic impulse is applied by the magnetic impulse reaction system. Virtually no heat is generated by the magnetic impulse reaction engine in order to prevent explosions and fires. The danger of injury and harm is also prevented with the inventive toys by the use of a projectile.

In the preferred form, only a single inductive coil is used. In some circumstances, however, it may be desirable to use more than one coil. Furthermore, safety coils can also be used to brake or decrease the speed of the projectile, if it is desired to do so.

The toy and the circuit in the base unit can also include one or more audible signaling devices (audible generators) such as a speaker(s). In the preferred form, the audible signaling device(s) emits one sound when the circuit is charging, another sound when the circuit is charged and the projectile is ready to be fired, and a third sound when the projectile is shot (launched). The sounds can be of different frequency, pitch, loudness, and/or duration.

In the preferred form, the novel propulsion toys comprise a safe projectile comprising a propulsion device with an elastomeric body that is connected to a propulsion tube containing a movable magnetically attractable propellant (magnetic material). Each of the novel propulsion toys also feature a base control unit with a magnetic coil and preferably a flash tube, which cooperate with the magnetic coil to provide a magnetic impulse reaction system and engine in the base unit, to propel the projectile. Electric circuitry including the sound circuitry is preferably contained in the base unit. No electrical circuitry need be contained in the projectile. Advantageously, the safe propulsion toys do not contain any combustible fuels, compression springs, or sharp edges which could injure children or spectators.

A preferred process to propel the toy, comprises matingly engaging a toy projectile to the base unit of the toy before propelling the projectile. The projectile comprises a propulsion device with an elastomeric propulsion body which is preferably connected to a propulsion tube that contains a moveable magnetically attractable propellant (magnetic material). The projectile can be in the form of: a toy rocket, a toy airplane, a toy glider, a wheeled vehicle toy, a toy automobile, a toy sports utility vehicle, a toy truck, a toy bullet, etc. The base unit comprises at least one magnetic coil and preferably a flash tube and audible signaling device (audible generator). Before the projectile is propelled, the propulsion tube is placed through the center of the coil, the propulsion body is adjusted to a storage position or prelaunch position, such that the propulsion body is seated against and positioned forwardly of the base unit, and the magnetically attractable propellant (magnetic material) is positioned rearwardly of the coil.

In order to propel the projectile, the coil is energized to emit a magnetic impulse(s). Preferably, a flash of light and sound are emitted upon energizing the coil to simulate an explosion, fire, ignition and propulsion. In the preferred process, the flash of light is generated and the coil is energized with the assistance of a flash tube connected in series with the coil. Once the coil is energized, the magnetic impulse causes the magnetically attractable propellant (magnetic material) to move, accelerate and pass through the coil. The accelerating magnetically attractable propellant (magnetic material) will then strike and impact against the rearward portion of the propulsion body connected to the propulsion tube so that the kinetic energy is transferred from the magnetically attractable propellant to the propulsion body. Desirably, the magnetically attractable propellant strikes the propulsion body with sufficient force to magnetically propel the projectile away from the base unit.

In the preferred forms, the safe attractable toys each have a base and a propulsion device. The base unit comprises a seat and defines a cavity that provides a propulsion tube-receiving receptacle. An electromagnetic coil annularly surrounds the cavity to emit a magnetic impulse(s) when energized. An electronic circuit activates and energizes the coil. Desirably, a flash tube is connected to the circuit to emit a flash of light to visually simulate an explosion, fire, and ignition upon activation of the coil. The magnetic impulse(s) from the coil electromagnetically propels the propulsion device away from the base unit.

Each of the propulsion devices of the preferred embodiments can comprise an elongated propulsion tube to engage the propulsion tube-receiving receptacle of the base unit. A plug, such as a foam rubber plug, is provided to close one of the ends of the propulsion tube. An elastomeric propulsion body is secured to the propulsion tube to close the other end of the propulsion tube. Preferably, the propulsion body has a front head portion with a resilient nose. A back (rearward) portion of the propulsion body is fixedly securely and connected to the propulsion tube. Before the projectile is propelled, the back portion of the propulsion body is positioned upon and engages the seat of the base unit. The propulsion tube preferably can have a hollow interior which contains a magnetically attractable metal propellant (magnetic material). The magnetically attractable propellant provides a driver which is propelled by the magnetic impulse(s) of the coil when the coil is energized. In the preferred embodiments, the magnetically attractable propellant travels, moves and accelerates from the rearward plug, at location rearwardly of the coil, through the interior of the coil, to the propulsion body at a location forwardly of the coil, when the propulsion tube is in the receptacle of the base unit and the coil is energized. The magnetically attractable metal propellant is propelled against, strikes, abuttingly engages, and transfers its kinetic energy to the propulsion body with .sufficient force and momentum to propel the projectile away from the base unit.

In the preferred embodiments, the circuit includes a capacitor connected in parallel with the coil, preferably a single induction coil. Preferably, the coil cooperates with the flash tube and circuit to provide a light-emitting magnetic impulse reaction system.

The magnetically attractable propellant can be of any shape but preferably comprises a metal ball, a metal pellet, a metal cylinder, or a metal disc.

A more detailed explanation of the invention is provided in the following description and appended claims takes in conjunction with the accompanying drawings.

BRIEF DESCRIPTION OF THE DRAWINGS

FIG. 6 is a graph of the velocity of the propellant and rockets as a function of time when the magnetic field of the coil was maintained after the propellant exited the center of the magnetic coil;

FIG. 7 is a graph of the velocity of the propellant and rockets as a function of time when the magnetic field was closed (terminated) after the propellant entered the center of the magnetic field;

DETAILED DESCRIPTION OF THE PREFERRED EMBODIMENTS

Magnetic impulse reaction driven propulsion toys described below provide toy assemblies, units, and propulsion systems which are safe, sturdy, and dependable. Each of the toys comprises a projectile and a base unit to propel the projectile.

Figure 1:
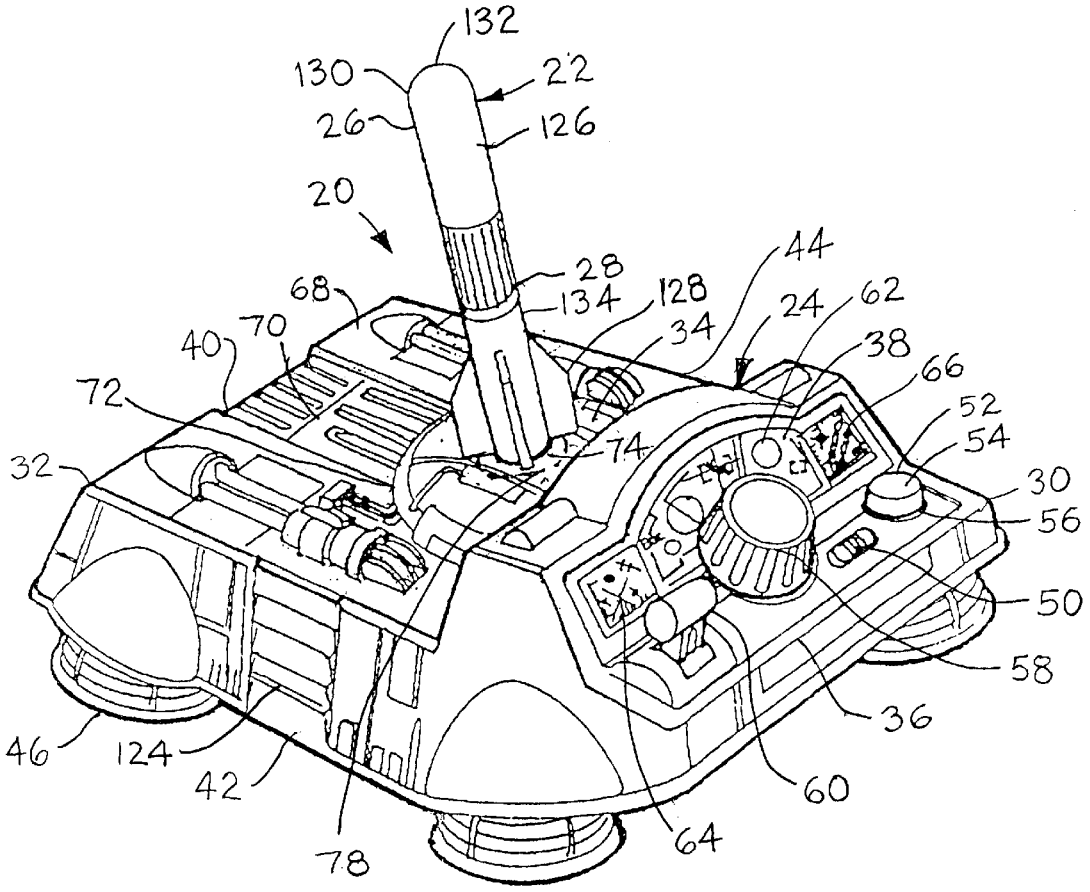
FIG. 1 is a perspective view of a toy rocket seated in a launch station comprising a launch pad in accordance with principles of the present invention.
Figure 2:
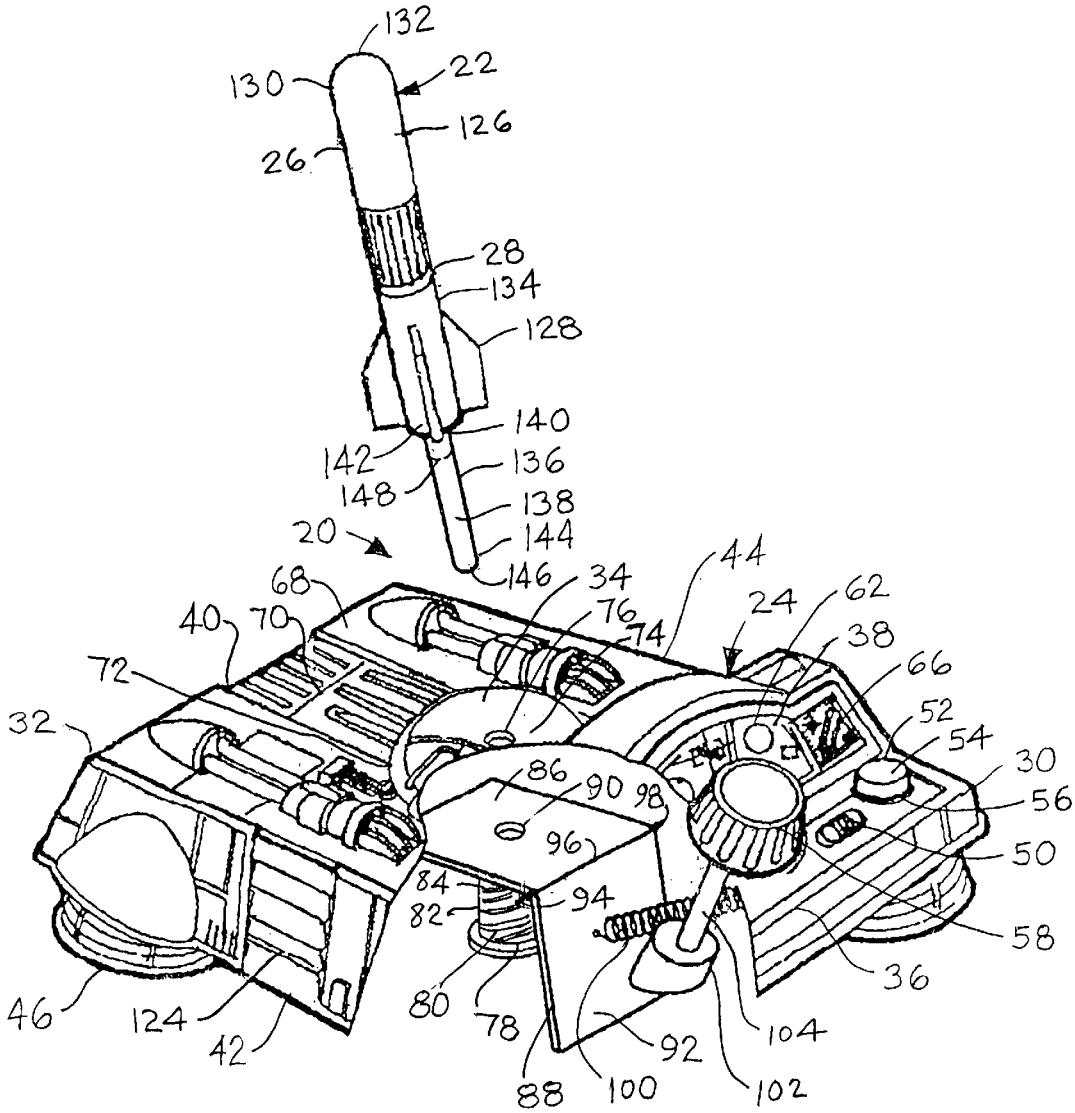
FIG. 2 is a perspective view of the toy rocket being launched from the launch station and showing a fragmentary view of the launch station with portions broken away for ease of understanding.

In FIGS. 1 and 2, the magnetic impulse reaction driven propulsion toy 20 comprises a toy rocket 22 and launch station 24. The toy rocket comprises a magnetic impulse reaction rocket which provides a projectile 26 comprising a propulsion device 28. The launch stations provides a base unit 30 with a plastic housing 32 having a raised launch pad 34. The housing has: an upperwardly extending stepped front wall 36 which provides a control panel 38, a back (rear) wall 40 which is shorter and positioned opposite the front wall, and left and right side walls 42 and 44 which extend between and integrally connect the front and back walls. The walls can diverge and slope downwardly. Stabilizing feet 46 are provided to elevate and stabilize the housing walls. The control panel has: an on-off power switch 50, an ignition switch 52 comprising a launch button 54 which provides a trigger switch 56, a center beveled scalloped control knob 58 to adjust the launch angle, a charge lever 60, and panel displays 62 with light emitting diodes (LEDs) 64 and 66. The LEDs can blink and can comprise neon or zeon lights. The housing has a ceiling 68 which provides a platform 70 and a support surface 72 for the launch pad. The launch pad comprises a seat 74 with a rocket sleeve guide hole 76 which defines an opening and cavity that provides a propulsion tube-receiving compartment or receptacle.

An electromagnetic induction coil(s) 78 (FIGS. 1 and 2) annularly surrounds the rocket sleeve guide hole and emits a magnetic impulse(s) when energized. The coil(s) can comprise a spiral or helical coiled wire 80 (FIG. 2) wound on a plastic bobbin or cylinder 82. The coiled wire can be insulated with plastic insulation tape 84. The top of the coil can be mounted against the upper tilting arm 86 of the tilt mechanism 88. The upper tilting arm has a propulsion tube guide hole 90 which is slightly larger than and axially aligned with the rocket sleeve guide hole of the launch pad. The propulsion tube guide hole is also axially aligned with the center and axis of the coil and cylinder (bobbin). The propulsion tube guide hole further provides a propulsion tube-receiving compartment or receptacle. The tilting mechanism has a front tilting arm 92 which is integrally connected to the upper tilting arm. An axle 96 with pivot pins 94 and 98 comprises a hinge at the intersection of the upper and front tilting arms. The pivot pins engage and pivot in pivot pin-apertures in the housing. A coiled compression spring 100 can be connected to the housing and securely connects, biases and urges the front tilting arm toward the front wall of the housing. An offset cam 102 engages the lower portion of the front tilting arm. A shaft 102 extends between and connects the cam and the control knob. When the control knob is turned, the cam will pivot and engage the front tilting arm to change the angle of inclination (tilt) of the upper and front tilting arms of the tilt mechanism in order to adjust the launch angle (angle of launch) of the rocket.

Figure 5:
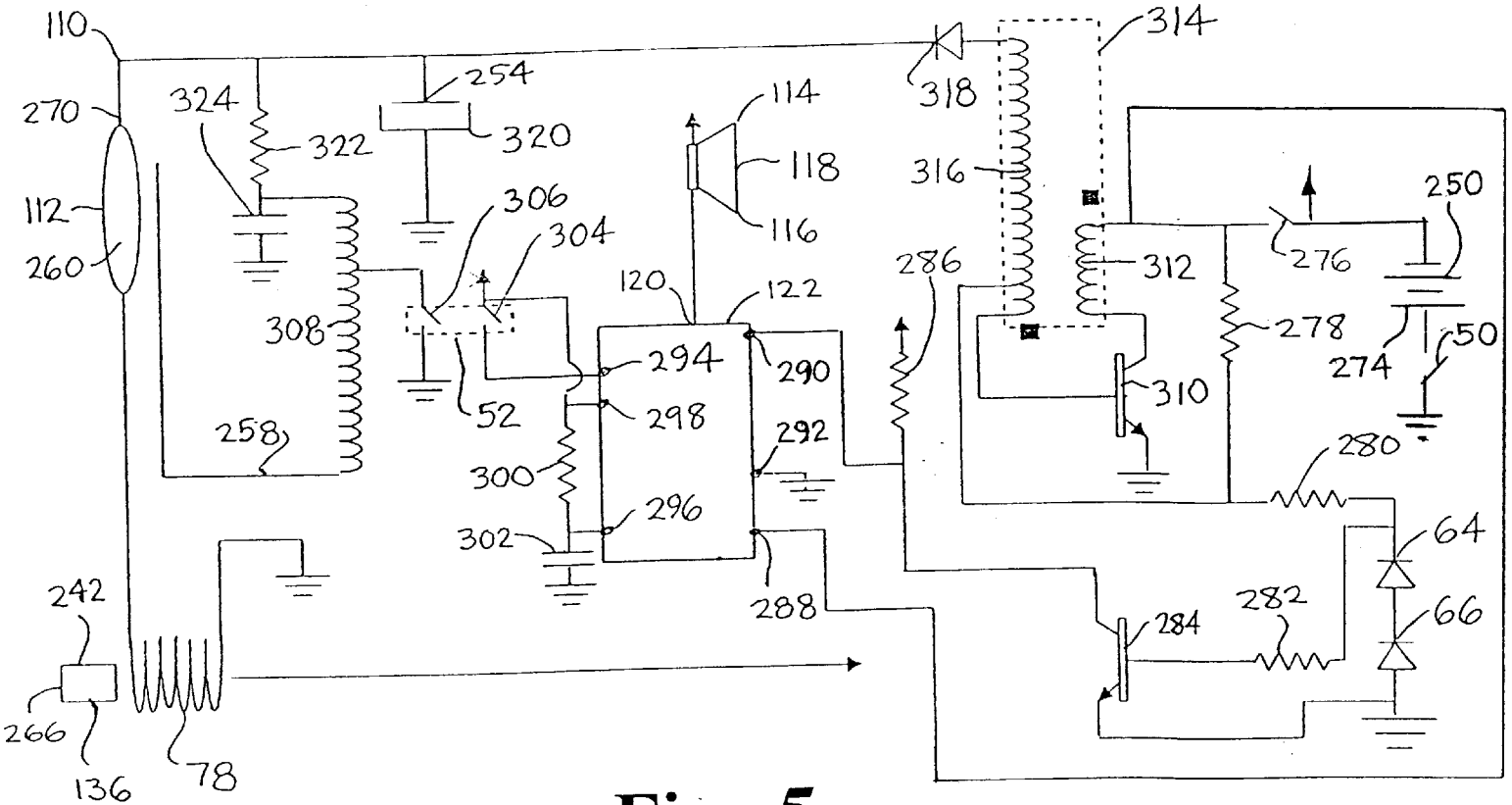
FIG. 5 is a schematic circuit diagram of a magnetic impulse reaction system.

The base unit contains an electric circuit 110 as shown in FIG. 5 to activate and energize the coil 78. A flash tube 112 provides a switch which is connected to the circuit to emit a flash of light to visually simulate fire, explosion and ignition when the coil is energized. An audible signaling device 114 provides an acoustical and audible generator 116 which includes a speaker(s) 118 and sound circuitry 120 comprising an integrated circuit 122 which is coupled, linked, and connected to the electric circuit in the base unit. The housing, such as the housing's front walls, control panel, or ceiling of the launch station comprising the base unit, has one or more apertures which provide speaker holes 124 (FIGS. 1 and 2) to emit sound from the speaker(s). The speaker(s) generates a sound which simulates an explosion, ignition, take-off and propulsion when the rocket is launched. Preferably, the speaker(s) emits a low pitch, soft, continuous humming sound or an intermittent humming sound of relatively long duration when the charge lever is pulled and the capacitor and circuit are charging. Desirably, the speaker(s) emit a siren-like higher pitch, louder, higher frequency sound or intermittent blast of short pulses when the capacitor and circuit is fully charged and the rocket is ready to be launched. The coil cooperates with the circuit, flash tube, audible signaling device, and sound circuitry to provide a light-emitting sound-generating magnetic impulse reaction system and engine.

The toy rocket is electromagnetically propelled by the magnetic impulses of the coil and launched away from the base unit. The toy rocket comprises an elongated elastomeric propulsion body 126 (FIGS. 1 and 2) with flexible fins 128 to stabilize the flight of the rocket. The propulsion body has a front head portion 130 with a rounded convex resilient nose 132. The elongated rearward (back) portion 134 of the propulsion body is positioned rearwardly of the nose and radially inwardly of the fins. The propulsion body and fins preferably comprise sponge rubber, foam rubber, or foam rubber-like plastic. An elongated plastic propulsion tube 136 (FIG. 2) comprises a hollow semi-rigid plastic sleeve 138. The propulsion tube has an upper end 140 which is axially aligned with, positioned within, glued or otherwise fixedly secured to, and closed by the rearward (back) portion 142 of the propulsion body. The propulsion tube also has a lower sealed end 144 which is closed by a plug 146, such as a foam rubber plug. The propulsion tube engages and fits within the propulsion tube-receiving compartment (receptacle) of base unit before the toy rocket is propelled by the magnetic impulse(s) of the coil. The propulsion tube has a hollow interior which extends between the upper and lower ends of the plastic sleeve.

The toy rocket has a movable magnetically attractable propellant 148 (FIG. 2) which can comprise a metal ball, a metal pellet, a metal cylinder, or a metal disc. The metal in the magnetically attractable propellant can comprise iron or an iron alloy. Preferably, the magnetically attractable propellant provides a driver which is positioned in the hollow interior of the propulsion tube. The magnetically attractable propellant (magnetic material) is propelled and accelerated when the coil is energized and the propulsion tube is positioned in the tube-receiving compartment (receptacle) of the launch station. The magnetically attractable propellant is propelled and accelerated from the plug at a level below the coil, upwardly through the interior of the coil, to engage, strike and transfer its kinetic energy to the back (rearward) portion of the propulsion body. The magnetically attractable propellant is propelled and accelerated with sufficient force and momentum by the magnetic impulse(s) of the coil to launch and propel the toy rocket away from the launch station. The propulsion body of the toy rocket should have sufficient impact strength to receive and absorb the impact force of the propellant and its kinetic energy without permitting the propellant to penetrate or pierce the propulsion body of the toy rocket.

Figure 3:
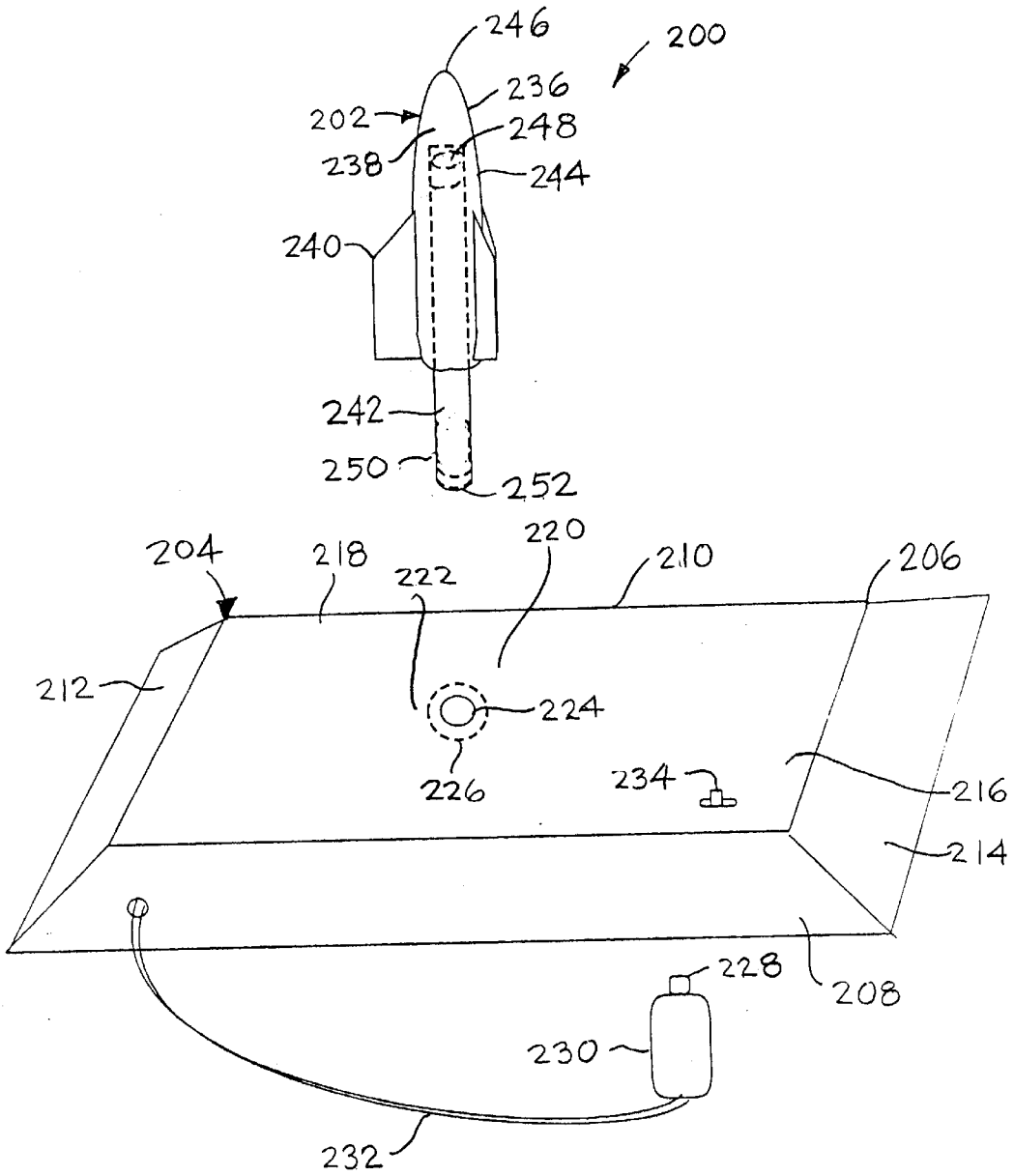
FIG. 3 is an assembly view of another toy rocket and launch pad in accordance with principles of the present invention.

The magnetic impulse reaction driven propulsion toy 200 of FIG. 3 comprises a toy rocket 202 and base unit (base) 204 which is structurally and functionally similar in many respects to the toy rocket and base unit of FIG. 1. The base unit comprises a plastic housing 206 with slopping downwardly diverging walls including a front wall 208, a back (rear) wall 210, and side walls 212 and 214 which extend between and integrally connect the front and back walls. The housing has a generally planar or flat support platform 216 which provides a ceiling 218 and launch pad 220 for the housing. The launch pad provides a seat 222 and has a rocket sleeve guide hole 224 which defines an opening and cavity that provides a propulsion tube-receiving compartment or receptacle. Positioned within and annularly surrounding the rocket sleeve guide hole, is a launch coil 226 comprising an electromagnetic induction coil. The coil emits a magnetic impulse(s) when energized. A launch button 228 provides an ignition button on a handgrip 230 which can be connected by a wire 232 to electric circuitry positioned in the interior of the housing. An on-off power switch 234 can extend from an end portion of the support platform. The electric circuit 110 in the housing can be the same as shown in FIG. 5. A flash tube 112 provides a switch which is connected to the circuit to emit a flash of light to visually simulate fire, explosion and ignition when the coil is energized. The circuit can also include an audible signaling device such as the one described in the propulsion toy of FIGS. 1 and 2.

The toy rocket of FIG. 3 comprises a magnetic impulse reaction rocket which provides a projectile 236 comprising a propulsion device 238. The toy rocket of FIG. 3 is structurally and functionally similar to the toy rocket of FIGS. 1 and 2, except that the fins 240 and propulsion tube 242 of FIG. 3 are longer than the fins and propulsion tube of the toy rocket of FIG. 2. The propulsion body 244 of the toy rocket of FIG. 3 is also shorter than the propulsion body of the toy rocket of FIG. 1. Furthermore, the nose 246 of the propulsion body of the toy rocket of FIG. 3 has a smaller curvature and radius than the nose of the propulsion body of the rocket of FIGS. 1 and 2. The movable magnetically attractable propellant 248 is structurally and functionally similar to the movable magnetically attractable propellant of the rocket of FIG. 2. The lower sealed and 250 of the propulsion tube is closed by a plug 252, such as foam rubber plug.

Figure 4:
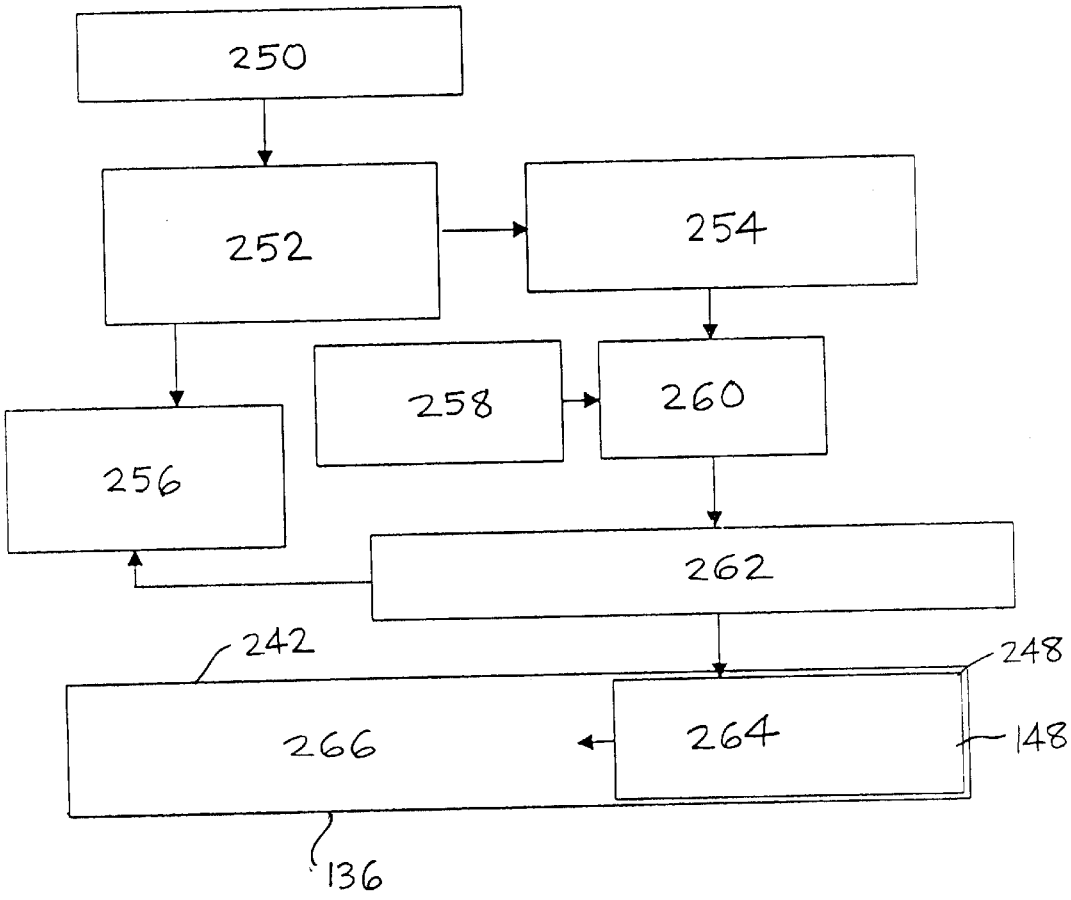
FIG. 4 is a block flow diagram of a magnetic impulse reaction system.

FIG. 4 is a block flow diagram of the magnetic impulse reaction system for propelling, accelerating and powering the magnetic impulse reaction driven propulsion toys of FIGS. 1–3. A power source 250 drives and powers a high voltage generator 252, such as a transformer. While an alternating current (A.C.) power source can be used, it is preferred to use a direct current (D.C.) power source, such as one or more batteries. The high voltage generator is capable of producing a sufficient voltage to fully energize and charge a charge storage device 254, such as a capacitor. As the charge storage device is being energized and charged, an audible signaling device 256 (audible generator), such as a speaker, generates a humming sound. When the charge storage device is fully energized and charged, the speaker will generate a siren-like sound to indicated that the rocket is ready to be launched. In order to launch the rocket, the ignition (launch) button, which provides a trigger switch in the trigger circuit 258, is depressed or otherwise activated to electronically trigger a very low current trigger pulse from the trigger circuit to a visual signal generator 260 comprising a flash tube. The flash tube will then generate a flash of light in a manner somewhat similar to the flash on a camera. The trigger pulse and much of the energy dissipated form the flash tube is used to trigger and release the power in the charge storage device 254 (capacitor). Power in the charge storage device is rapidly transferred to a magnetic field generator 262 comprising one or more induction coils (launch coils). The induction coil(s) will then generate a magnetic field and magnetic impulse(s) which will produce a magnetic force on the magnetically attractable propellant 264 (magnetic material) to magnetically attract and propel the magnetically attractable material in the propulsion tube 266 through the center of the coil with sufficient momentum to move upwardly (forwardly) of the coil so as to propel and launch the rocket (projectile) away from the base unit. When the magnetic filed is generated and immediately upon lift off (launch), the speaker will generate a roaring propulsion sound simulating the ignition blast and propulsion of an actual rocket, such as a rocket launched at Cape Kennedy, Fla.

The electrical schematic diagram of FIG. 5 provides an electric circuit 110 for the light-emitting sound-generating magnetic impulse reaction system and engine. The circuit includes triggering (trigger) circuitry 258, light-emitting circuitry 270, and sound generating circuitry 120. In the circuit, a battery (B+) 274 provides a power source which is connected to the on-off power switch 50. A charging switch 276 comprising a charging (charge) lever 60 is also connected to the power source. A resister 278 is positioned between and directly connected to the charging switch and another resister 280. A series of light emitting diodes (LEDs) 64 and 66 are directly connected to resistor 280. The anode portion of the light emitting diode 66 is grounded. A resistor 282 extends between and is connected to the cathode portion of the light emitting diode 64 and the base portion of a transistor 284. The emitter portion of the transistor 284 is grounded. The collector portion of the transistor 284 is connected to resistor 286 and to the integrated circuit 122 of the sound circuitry 120. The resistor 286 is connected to the battery (power source). The integrated circuit 122 can include pins, such as a P1 pin 288, a P2 pin 290, a ground (grounded) pin 292 positioned between the P1 and P2 pins, a P3 input pin 294, an oscillating pin 296, and a B+ pin 298 positioned between the P3 input pin and the oscillating pin. A resistor 300 is positioned between and connected in parallel to the B+ pin 298 and the oscillating pin 296. A capacitor 302 has one end connected in parallel to the resistor 300 and the oscillating pin. The other end of the capacitor 302 is grounded. The resistor 300 and the B+ pin are also connected in parallel to the second pole 304 of the ignition switch 52. The first pole 306 of the ignition switch is connected to a trigger transformer 308 and to ground.

A transistor 310 (FIG. 5) is connected to coil 312 which is connected in parallel to resistor 278. The collector portion of the transistor 310 can be connected to the low voltage smaller coils 312 of a transformer 314. The base portion of the transistor 310 can be connected to the high voltage larger coils 316 of the transformer 314. The emitter portion of the transformer 314 can be grounded. The smaller coils 312 of the transformer 314 are directly connected to the charging switch 276 and are also connected in parallel to the resistor 278. The high voltage coils 316 of the transformer 314 are also connected in parallel to resistor 278 and resistor 280. The high voltage coils 316 of the transformer 314 are connected to the anode portion of a diode 318. A capacitor 320 provides a charge storage device 254 which is positioned between and connected to the diode 318 and ground.

The trigger (triggering) circuit 258 (FIG. 5) is positioned between and connected in parallel to the capacitor 320 comprising the charge storage device 254 and the visual signaling device (generator) 260 comprising a flash tube 112. The trigger circuit comprising a launch button providing an ignition switch 52 which is positioned between and connected to the trigger transformer 308 and ground. The trigger transformer is connected in parallel to a resistor 322 and a trigger capacitor 324 which is grounded. An induction coil 78 comprising a magnetic filed generator 262 is positioned between and directly connected to the flash tube 112 and ground.

When the charging lever comprising the charging switch 276 (FIG. 5) is closed, the transistor 310 will oscillate because of positive feedback from the transformer 314. The transformer 314 will produce a high voltage on the anode side of the diode 318. Current passes through the diode 318 to charge the capacitor 320 comprising the charge storage device 254 to the peak voltage produced by the transformer 314. A very small amount of the charging current is used to charge the trigger capacitor 324 through the resistor 322 of the trigger circuit 258. When the charge storage device 254 comprising the capacitor 320 is fully charged, the load on the transformer 314 is reduced causing the voltage on the base of the transistor 310 to produce a negative voltage to activate the light emitting diodes 64 and 66. This will cause the transistor 284 to turn off through resistor 282 putting the P2 pin 290 of the integrated circuit 122 of the sound circuitry 120 at B+ through resistor 286. This will cause the speaker 118 to emit a warning sound that the system is ready to launch. When the first pole 306 of the launch button comprising the ignition switch 276 is closed, the trigger capacitor 324 discharges through the trigger transformer 308 to produce a high voltage near the flash tube 112. This causes the gas in the flash tube to ionize to dissipate energy in the flash tube and produce a flash of light. The dissipation of energy in the flash tube allows the charge storage device 254 comprising the capacitor 320 to discharge through the launch coil 78 (ignition coil) comprising the magnetic field generator 262 which causes the coil 78 to generate a magnetic field and a magnetic impulse(s) to propel the magnetically attractable propellant 136, 242 or 266 through the coil to launch the rocket upwardly and away from the launch pad of the base unit. Since the second pole 304 of the ignition switch 52 closes at the same time as the first pole 306 of the ignition switch, the P3 input pin 294 will be raised to B+ changing the sound in the speaker 118, at the same time as the magnetic field is produced in the coil, to a propulsion (launch) sound.

In the magnetic impulse reaction rockets and toys the propellant is propelled at a velocity in accordance with the following equation:

$$V_p = V_{max} \mathrm{Sin}\ (t\pi/2Tm) e^{-\tau F}$$

wherein:

$V_p$=velocity of the propellant $V_{max}$=maximum attainable velocity of the propellant $T_m$=time for the propellant to reach the center of the magnetic field of the coil F=magnetic force on the propellant $\tau_o$=time when the magnetic field is initially applied to the propellant $\tau_x$=time when the magnetic field is removed (dissipated)

$\tau = \tau_x - \tau_o$

As discussed above, when the flash tube is triggered, it will activate the induction coil (launch coil). The induction coil will generate a magnetic field which creates a magnetic impulse(s). The magnetic field cooperates with the magnetic impulse(s) to attract the magnetically attractable propellant (magnetic material) and moves, pushes, and propels the propellant through the interior of the coil to the center of the magnetic field. If the coil remains activated to generate a magnetic field after the propellant exits the center of the magnetic field in the coil, the magnetic field will pull, restrain, and retard the velocity of the propellant in an attempt to draw the propellant back towards the center of the magnetic field in which there is a greater density of lines of magnetic force. In view of the above, it is preferred to shut off, stop and quickly dissipate the magnetic field and magnetic impulse(s) when the propellant has entered the center of the magnetic field and has attained its maximum velocity and momentum.

Factors that effect the magnetic field and magnetic impulse(s) are: value of the inductance and amount of resistance in the induction coil (launch coil) 78 (FIG. 5); the value of capacitance, the amount of resistance, and the voltage on the charge storage device 254 comprising the capacitor 320; and the ionization resistance of the flash tube 112. The factors that effect the time for the propellant 136, 242 or 266 to reach the center of the magnetic field are: the strength of the magnetic field; the initial starting distance of the propellant from the center of the magnetic field; the weight, mass, size, and shape of the propellant; the friction on the propellant; and the type of magnetic material in the propellant.

Placing a high voltage on the charge storage device 254 (FIG. 5) comprising the capacitor 320 allows the flash tube to be triggered by a momentary voltage spike which ionizes the gas in the flash tube 112. When ionization occurs, the flash tube's resistance is very low placing the capacitor 320 in parallel with the induction coil 78. Ionization of the flash tube causes current to flow in the induction coil. The magnetic field is produced by current in the induction coil. When the flash tube ionization ceases, the current in the induction coil is stopped, i.e. becomes zero, causing the magnetic field to immediately dissipate, cease, and stop, i.e. becomes zero.

EXAMPLES 1–14

The toy rockets of FIGS. 1–3 were tested to determine the velocity of the propellant and corresponding velocity of the rockets. During the first phase of the test, the magnetic field was kept on and the coil remained energized even after the propellant entered the center of the magnetic field. The propellant took 0.0001 seconds to reach the center of the magnetic field and attain a maximum velocity of 100 cm/sec at a magnetic force of 100 dynes. The velocity of the propellant and the rockets when the coil remains activated and the magnetic field is kept on even after the propellant enters the center of the field, is shown in column 3 of Table 1 below. A plot of the velocity of the propellant and rockets as a function of time when the coil remains activated and the magnetic field is kept on even after the propellant enters the center of the magnetic field, is shown in the graph of FIG. 6.

In the second phase of the test, the flash tube ionization and induction (activation) of the coil was stopped to eliminate, stop and dissipate the magnetic field when the propellant entered the center of the magnetic field. The time for the propellant to reach the center of the magnetic field was 0.0001 seconds. The velocity of the propellant and the rockets under these conditions is shown in column 6 of Table 1. The velocity of the propellant and the rockets as a function of time is plotted and shown in the graph of FIG. 7 for these conditions.

The period of the sin wave produced by the parallel combination of the coil 78 (FIG. 5) and the capacitor 320 providing the charge storage device 254 is equal to the square root of the product of inductance in Henries of the coil 78 and the capacitance in Farads of the capacitor 320. When the inductance of the coil equals 0.004 Henries and the capacitance of capacitor 320 equals 0.00004 Farads, the period is 0.0004 seconds. Since the first peak is equal to one fourth of the period, the best time to remove the magnetic field is 0.0001 seconds, i.e. when the propellant enters the center of the magnetic field.

The examples include actual physical test data taken from the propellant and rockets, as well as data taken by extrapolation and computer simulation of the propellant and rockets.

TABLE 1

Velocity Of The Propellant And Rockets

| Column 1 Example | Column 2 Time (seconds) | Column 3 Velocity Phase 1 (cm/sec) | Column 4 Sin ($\tau\pi/2T_m$) | Column 5 $e^{-\tau F}$ | Column 6 Velocity Phase 2 (cm/sec$^2$) |
|---|---|---|---|---|---|
| 1 | .00005 | 70.3 | .707 | .995 | 70.3 |
| 2 | .00009 | 97.9 | .988 | .991 | 97.9 |
| 3 | .0001 | 99 | 1.00 | .990 | 99 * ($\tau_x = T_m$) |
| 4 | .00011 | 97.7 | .988 | .989 | 99 (F = 0) |
| 5 | .00015 | 69.6 | .707 | .985 | 99 |
| 6 | .0002 | 0 | 0 | .980 | 99 |
| 7 | .0003 | −97 | −1 | .970 | 99 |
| 8 | .0004 | 0 | 0 | .960 | 99 |
| 9 | .0005 | 95.1 | 1.00 | .951 | 99 |
| 10 | .001 | 0 | 0 | .905 | 99 |
| 11 | .02 | 13.5 | 1 | .135 | 99 |
| 12 | .1001 | .005 | 1 | .00005 | 99 |
| 13 | .2001 | .0000002 | 1 | .000000002 | 99 |

As can be seen from Table 1, during the first phase of the test, when flash tube ionization and induction (activation) of the coil where kept on to maintain the magnetic field even after the propellant entered the center of the magnetic field, the velocity of the propellant oscillated within the tube as shown in FIG. 6 and the rocket did not fly. The oscillation ceased after approximately 0.2 seconds as shown in Example 13.

As can be seen from Table 1, in phase 2 of the test, when the propellant entered the center of the magnetic field after 0.0001 seconds and attained its maximum velocity, flash tube ionization and induction (activation) of the coil was stopped to terminate the magnetic field. The momentum of the propellant, however, caused the rocket to be propelled away from the base unit at the same maximum velocity even after about 0.2 seconds as shown in Example 13.

Figure 8:
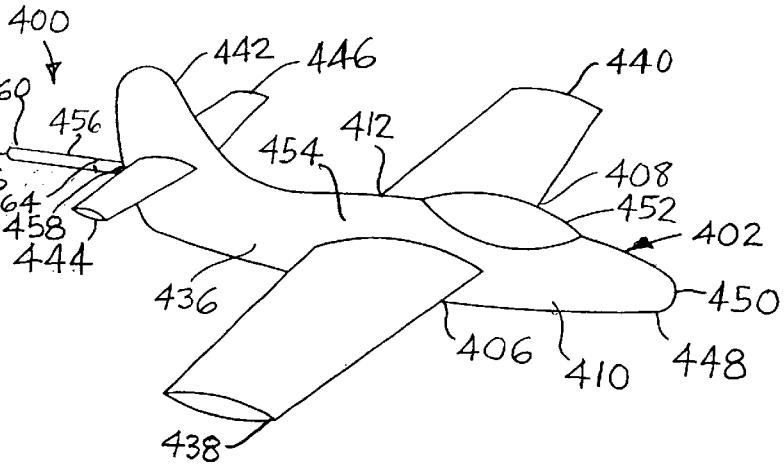
FIG. 8 is an assembly view of a toy airplane or glider and base unit in accordance with principles of the present invention.

The magnetic impulse reaction driven propulsion toy 400 of FIG. 8 comprises a toy aircraft 402 and base unit (base) 404 which is functionally similar in many respects to the toy rocket and base unit of FIG. 3. The toy aircraft comprises a magnetic impulse reaction aircraft comprising a toy airplane 406 or toy glider 408 which provides a projectile 410 comprising a propulsion device 412. The base unit comprises a plastic housing 414 with triangular side walls 416 and 418, a generally planar or flat floor 420 providing a bottom wall 422, and upwardly diverging end walls comprising a slopping back (rearward) wall 424 and a slopping front wall 426 which are connected and intersect each other at an apex 428. The front wall provides a launch pad 430 and has an aircraft sleeve guide hole 432 which defines an opening and cavity that provides a propulsion tube-receiving compartment or receptacle. Positioned within and annularly surrounding the aircraft sleeve guide hole, is a launch coil(s) 434 comprising an electromagnetic induction coil(s). The coil emits a magnetic impulse(s) when energized. The coil is connected to a circuit 110 (FIG. 5) in the interior of the housing. The circuit is structurally and functionally similar to the circuit in the housing of the rocket toys (magnetic impulse reaction driven propulsion toys) of FIGS. 1–3.

The toy aircraft of FIG. 8 is electromagnetically propelled by the magnetic impulse(s) of the coil and launched (shot) away from the base unit. The toy aircraft comprises an elongated elastomeric propulsion body 436 with flexible long wings 438 and 440, a tail 442, and tail fins 444 and 446. The wings, tail, and tail fins cooperate with each other to stabilize the flight of the aircraft. The propulsion body of the aircraft has a front head portion 448 with a rounded convex resilient nose 450. The aircraft can also have a cockpit 452 positioned behind the nose. The elongated rearward (back) portion 454 of the propulsion body is positioned rearwardly of the nose and radially inwardly of the wings and tail fins. The propulsion body, wings, tail, and tail fins, preferably comprise sponge rubber, foam rubber, or foam rubber-like plastic. An elongated plastic propulsion tube 456 comprises a hollow semi-rigid plastic sleeve. The propulsion tube has a forward end 458 which is axially aligned with, positioned within, and glued or otherwise fixedly secured to, and closed by the rearward (back) portion of the propulsion body. The propulsion tube also has a lower sealed end 460 which is closed by a plug 462, such as a foam rubber plug. The propulsion tube engages and fits within the propulsion tube-receiving compartment (receptacle) of the base unit before the toy aircraft is propelled by the magnetic impulse (s) of the coil. The propulsion tube has a hollow interior which extends between the upper and lower ends of the plastic sleeve.

The toy aircraft has a movable magnetically attractable propellant 464 (FIG. 8) which can comprise a metal ball, a metal pellet, a metal cylinder, or a metal disk. The metal in the magnetically attractable propellant can comprise iron or an iron alloy. Preferably, the magnetically attractable propellant provides a driver which is positioned in the hollow interior of the propulsion tube of the aircraft. The magnetically attractable propellant (magnetic material) is propelled and accelerated when the coil is energized and the propulsion tube is positioned in the tube-receiving compartment (receptacle). The magnetically attractable propellant is propelled and accelerated from the plug at a level behind (rearwardly) of the coil, through the interior of the coil, to engage, strike and transfer its kinetic energy to the back (rearward) portion of the propulsion body of the aircraft. The magnetically attractable propellant is propelled and accelerated with sufficient force and momentum by the magnetic impulse(s) of the coil to launch and propel the toy aircraft away from the base unit. The propulsion body of the toy aircraft should have sufficient impact strength to receive and absorb the impact force of the propellant and its kinetic energy without permitting the propellant to penetrate or pierce the propulsion body of the toy aircraft.

Figure 9:
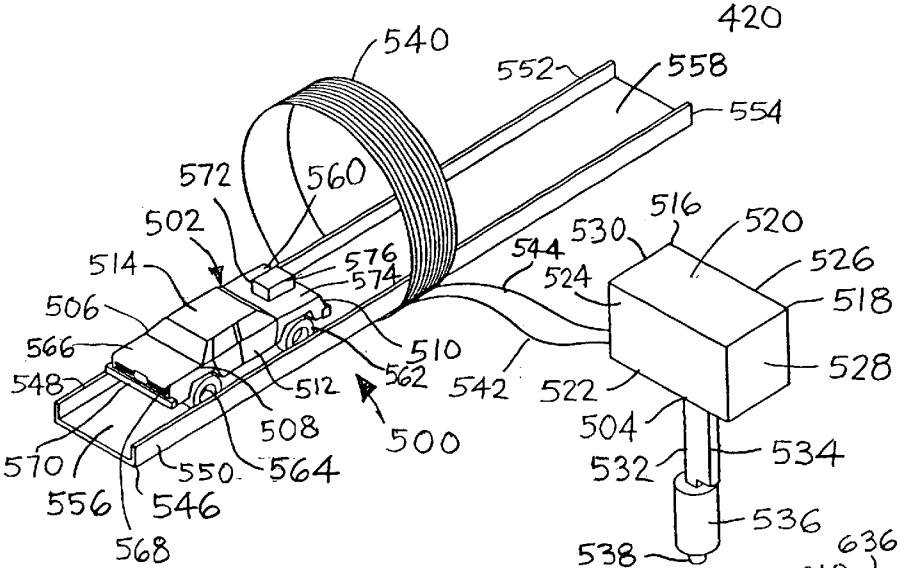
FIG. 9 is a perspective view of a toy wheeled vehicle on a track extending through a coil of a base unit in accordance with principles of the present invention.

The magnetic impulse reaction driven propulsion toy 500 of FIG. 9 comprises a wheeled vehicle toy 502 and base unit (base) 504 which is functionally similar in many respects to the rocket and base unit of FIG. 3. The wheeled vehicle toy comprises a magnetic impulse reaction vehicle 506 comprising a toy automobile (car) 508 or a toy sports utility vehicle 510, which provides a projectile 512 comprising a propulsion device 514. The base unit comprises a portable mobile hand-held plastic housing 516 comprising a box 518 with a top wall 520, a bottom wall 522, upright side walls 524 and 526, and upright end walls comprising a front wall 528 and a back (rearward) wall 530. A pedestal 532 comprising an upright arm 534 is connected to the bottom of the housing. An enlarged handgrip 536 is connected to the bottom of the arm. The handgrip can be fixedly secured to the ground or a floor by a downwardly extending connector 538.

An electromagnetic induction coil(s) 540 (FIG. 9) is connected by wires 542 and 544 to a circuit 110 (FIG. 5) within the interior of the housing of the base unit. The circuit can be structurally and functionally similar to the circuit of the magnetic impulse reaction driven propulsion toys of FIGS. 1–3. The coil emits a magnetic impulse(s) when energized. An elongated track 546 can extend through the bottom portion of the interior of the coil(s). The track can have a generally U-shaped configuration with upwardly extending flanges 548 and 550 that provide guide walls 552 and 554, respectively, and a generally planar or flat surface 556 that provides a road (roadway) 558 between the guide walls upon which the toy vehicle rides. The wheeled vehicle toy (toy vehicle) is electromagnetically driven and propelled on the track by the magnetic impulse(s) of the coil(s) and is moved, driven, accelerated, propelled, and launched away from the coil(s) of the base unit.

The wheeled vehicle toy 502 (FIG. 9) comprises an elongated elastomeric propulsion body 560 with rotating wheels 562 mounted on axles 564. The propulsion body of the vehicle has a front head portion 566 with a resilient nose 568 having a fender 570. The propulsion body, nose and fender, preferably comprises sponge rubber, foam rubber, or foam rubber-like plastic. The vehicle can have an elongated plastic propulsion tube 572 which comprises a rectangular or cylindrical hollow semi-rigid plastic sleeve. The propulsion tube is fixedly mounted on the rearward (back) portion 574 of the propulsion body. The toy vehicle has a magnetically attractable propellant 576 which can comprise a metal ball, a metal pellet, a metal cylinder, or a metal disc. The metal in the magnetically attractable propellant can comprise iron or an iron alloy. The propellant can be glued or otherwise fixedly secured to the propulsion tube or to the propulsion body or can be movably positioned within the interior of the propulsion tube. The magnetically attractable propellant provides a driver which is propelled and accelerated when the coil(s) is energized. The magnetically attractable propellant is propelled and accelerated from a position behind (rearwardly) of the coil, through the interior of the coil, to engage, strike and transfer its kinetic energy to the back (rearward) portion of the propulsion body. The magnetically attractable propellant is propelled and accelerated with sufficient force and momentum by the magnetic impulse(s) of the coil(s) to move, shoot, drive, and propel the toy vehicle away from the coil(s) of the base unit. The propulsion body of the toy vehicle should have sufficient impact strength to receive and absorb the impact force of the propellant and its kinetic energy without permitting the propellant to penetrate or pierce the propulsion body of the toy vehicle. The body of the vehicle can comprise magnetic material without using a propulsion tube.

Figure 10:
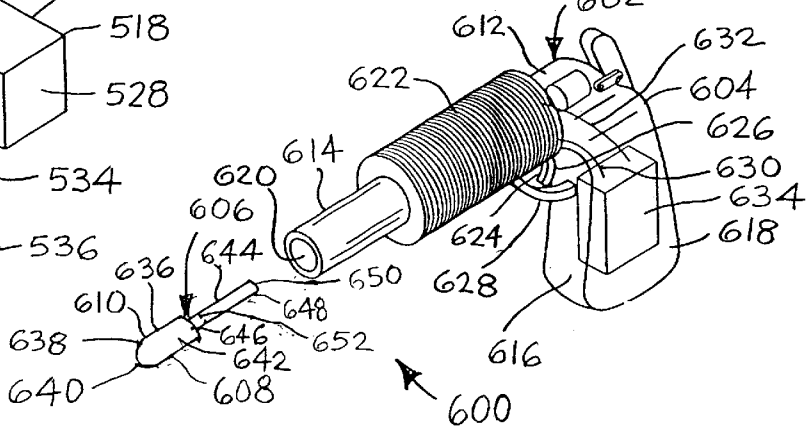
FIG. 10 is a perspective view of a toy gun and toy bullet in accordance with principles of the present invention.

The magnetic impulse reaction driven propulsion toy 600 of FIG. 10 comprises a toy gun 602 providing a base unit (base) 604 and a toy bullet 606. The toy gun and toy bullet are functionally similar in many respects to the launch station and toy rocket of FIGS. 1 and 2. The toy bullet comprises a magnetic impulse reaction bullet which provides a projectile 608 comprising a propulsion device 610. The toy gun comprises a plastic housing 612 with a barrel 614 connected to a pistol grip 616 which provides a handle 618. The barrel has a bullet sleeve guide hole 620 which defines an opening, bore, and cavity that provides a propulsion tube-receiving compartment of receptacle. Positioned around and annularly surrounding the barrel is a firing coil (launch coil) 622 comprising an electromagnetic induction coil. A trigger 624 provides a trigger switch (ignition switch) 626 which is connected to the coil. A trigger guard 628 provides a finger support which can be positioned below the trigger. The trigger guard can be connected to the handle. The coil is connected by wires 630 and 632 to a box 634 (casing) containing a circuit 110 (FIG. 5) within the interior of the handgrip (handle) of the toy gun. The circuit is structurally and functionally similar to the circuit of the magnetic impulse reaction driven propulsion toys of FIGS. 1–3. When the trigger is pulled, the flash tube 112 (FIG. 5) emits a light and activates the coil. Simultaneously, firing and propulsion sounds are emitted from the barrel of the gun. The coil(s) of the toy gun emits a magnetic impulse(s) when energized. The toy bullet is electromagnetically propelled and shot by the magnetic impulse(s) of the coil(s) and launched, propelled, accelerated, and shot away from the barrel of the toy gun.

The toy bullet comprises an elongated elastomeric propulsion body 636 (FIG. 10) with a front head portion 638 comprising a rounded convex resilient nose 640. The elongated rearward (back) portion 642 of the propulsion body is positioned rearwardly of the nose. The propulsion body preferably comprises sponge rubber, foam rubber, or foam rubber-like plastic. An elongated plastic propulsion tube 644 comprises a hollow semi-ridged plastic sleeve. The propulsion tube has a forward end 646 which is axially aligned with, positioned within, and glued or otherwise fixedly secured to, and closed by the rearward (back) portion of the propulsion body. The propulsion tube also has a rearward sealed end 648 which is closed by a plug 650, such as a foam rubber plug. The propulsion tube engages and fits within the propulsion tube-receiving compartment (receptacle) of the toy gun comprising the base unit before the toy bullet is shot and propelled by the magnetic impulse(s) of the coil(s). The propulsion tube has a hollow interior which extends between the forward and rearward ends of the plastic sleeve of the toy bullet.

The toy bullet can have a movable magnetically attractable propellant 652 (FIG. 10) which can comprise a metal ball, a metal pellet, a metal cylinder, or a metal disc. The metal in the magnetically attractable propellant can comprise iron or an iron alloy. Preferably, the magnetically attractable propellant provides a driver which is positioned in the hollow interior of the propulsion tube of the toy bullet. The magnetically attractable propellant (magnetic material) is propelled, shot, and accelerated when the coil(s) is energized and the propulsion tube is positioned in the tube-receiving department (receptacle) of the barrel of the toy gun. The magnetically attractable propellant is propelled, shot, and accelerated from the plug at a level behind the coil(s), through the interior of the coil(s), to engage, strike, and transfer its kinetic energy to the back (rearward) portion of the propulsion body of the toy bullet. The magnetically attractable propellant is propelled, shot, and accelerated with sufficient force and momentum by the magnetic impulse(s) of the coil(s) to shoot, propel and launch the toy bullet away from the toy gun. The propulsion body of the toy bullet should have sufficient impact strength to receive and absorb the impact force of the propellant and its kinetic energy without permitting the propellant to penetrate or pierce the propulsion body of the toy bullet.

Among the many advantages of the magnetic impulse reaction driven propulsion toys of this invention are:

1. Outstanding performance.
2. Superb propulsion.
3. Prevents injury to children as well as adults.
4. Prevents damage to furniture, walls, and ceilings.
5. Simple to use.
6. Easy to operate.
7. Excellent appeal.
8. Fun.
9. Safe.
10. Dependable.
11. Sturdy.
12. Economical.
13. Efficient.
14. Effective.

Although embodiments of this invention have been shown and described, it is to be understood that various modifications, substitutions and rearrangements of parts, components, and process steps, can be made by those skilled in the art without departing from the novel spirit and scope of this invention.

What is claimed is:

1. A toy comprising:

a base unit comprising a seat and defining a cavity providing a propulsion tube-receiving receptacle, an electromagnetic coil annularly surrounding said cavity for emitting a magnetic impulse when energized, a circuit for activating and energizing said coil, and a flash tube connected to said circuit for emitting a flash of light to visually simulate an explosion upon activation of said coil; and a projectile comprising a propulsion device for being electromagnetically propelled by said coil away from said base unit, said propulsion device comprising an elongated propulsion tube for engaging said propulsion tube-receiving receptacle of said base unit, said propulsion tube having opposite ends, a plug for closing one of said ends of said tube, an elastomeric propulsion body secured to said propulsion tube for closing the other end of said tube, said propulsion body having a front head portion with a resilient nose and having a back portion fixedly connected to said tube, said back portion being positioned upon and engaging said seat of said base unit before said propulsion device is propelled, said tube having a hollow interior between said ends, a moveable magnetically attractable metal propellant positioned in the hollow interior of said propulsion tube, said magnetically attractable propellant providing a driver, said driver being propelled from said plug at location rearwardly of said coil, through said coil to said back portion of said propulsion body at a location forwardly of said coil in response to said magnetic impulse of said coil when said coil is energized and said propulsion tube is in said receptacle to transfer kinetic energy from said propellant to said propulsion body in order to propel said projectile away from said base unit.

2. A toy in accordance with claim 1 wherein:

said circuit comprises a capacitor connected in parallel with said coil;

said coil comprises only a single induction coil; and said coil cooperates with said flash tube and circuit to provide a light-emitting magnetic impulse reaction engine.

3. A toy in accordance with claim 1 wherein said propellant is selected from the group consisting of: a metal ball, a metal pellet, a metal cylinder, and a metal disc.

4. A toy in accordance with claim 1 wherein:

said propulsion body comprises a material selected from the group consisting of sponge rubber, foam rubber, and foam rubber-like plastic; and said propulsion tube comprise a plastic tube.

5. A toy in accordance with claim 1 wherein:

said base unit comprises a toy gun; and said propulsion body comprises a toy bullet.

6. A toy in accordance with claim 1 wherein said propulsion body comprises a toy airplane or toy glider with wings.

7. A toy in accordance with claim 1 wherein said propulsion body comprises a wheeled toy vehicle.

8. A toy in accordance with claim 1 wherein:

said propulsion body comprises a toy rocket with flexible fins; and said base unit comprises a launch pad.

9. A toy in accordance with claim 1 including an audible signaling device connected to said circuit for emitting a sound upon activation of said coil.

10. A toy, comprising:

a base unit comprising a launch pad having a seat and defining an opening providing a propulsion tube-receiving compartment, an electromagnetic induction coil annularly surrounding said opening for emitting a magnetic impulse when energized, a circuit for activating and energizing said coil, and a flash tube providing a switch connected to said circuit for emitting a flash to visually simulate fire and ignition when said coil is energized; and a toy rocket comprising a projectile for being electromagnetically propelled by said coil and launched away from said base unit, said toy rocket comprising an elongated elastomeric propulsion body with flexible fins, said body having a front portion with a convex resilient nose and rearward portion positioned radially inwardly of said fins, an elongated plastic propulsion tube having an upper end axially aligned with and secured to and closed by said rearward portion of said propulsion body and having a lower end closed by a plug, said propulsion tube engaging said propulsion tube-receiving compartment of said base unit before being propelled by said coil, said tube having a hollow interior between the upper and lower ends, a moveable magnetically attractable propellant positioned in the hollow interior of said propulsion tube, said magnetically attractable propellant providing a driver for being propelled from said plug at a level below said coil, upwardly through said coil to said rearward portion of said propulsion body at a level above said coil in response to said magnetic impulse of said coil when said coil is energized and said propulsion tube is in said compartment to transfer kinetic energy from said propellant to said propulsion body in order to propel and launch said toy rocket away from said launch pad.

11. A toy in accordance with claim 10 wherein:

said propellant comprises at least one member selected from the group consisting of a metal ball, metal pellet, a metal cylinder, and a metal disc; and said propulsion body and said fins comprise a material selected from the group consisting of sponge rubber, foam rubber, and foam rubber-like plastic.

12. A toy in accordance with claim 10 including a control for adjusting the angle of inclination of said seat of said launch pad and angle of propulsion of said rocket.

13. A toy in accordance with claim 10 including an audible signaling device comprising at least one speaker connected to said circuit for generating sound.

14. A toy in accordance with claim 13 including sound circuitry operatively connecting said speaker to said circuit for generating one sound during energizing of said coil, another sound when said coil is energized, and a louder sound when the rocket is launched.

15. A process for propelling a toy, comprising the step of:

matingly engaging a toy projectile to a base unit of a toy before propelling the projectile, said projectile comprising a propulsion device with an elastomeric propulsion body connected to a propulsion tube containing a moveable magnetically attractable propellant, said base unit comprising a magnetic coil, said engaging comprising positioning said propulsion tube of said propulsion device through said magnetic coil of said base unit, seating said body of said propulsion device against and forwardly of said base unit, and placing said propellant rearwardly of said coil;

energizing said coil to emit at least one magnetic impulse;

accelerating said propellant through said coil to said propulsion body of said propulsion device in response to said magnetic impulse; and magnetically propelling said projectile away from said base unit.

16. A process in accordance with claim 15 including emitting a flash of light to simulate an explosion and fire upon energizing of said coil.

17. A process in accordance with claim 15 including generating a propulsion sound when said projectile is propelled.

18. A process in accordance with claim 17 including generating a humming sound when said coil is energizing.

19. A process in accordance with claim 18 including generating a higher frequency sound when said coil is ready to launch.

20. A process in accordance with claim 15 wherein said projectile is selected from the group consisting of: a toy rocket, a toy airplane, a toy glider, a wheeled vehicle toy, a sports utility toy, a toy automobile, and a toy bullet.

21. A process in accordance with claim 15 wherein said propellant is propelled at a velocity in accordance with the following equation:

$$V_p = V_{max} \operatorname{Sin}(t\,\pi/2Tm)e^{-\tau F}$$

wherein:

$V_p$=velocity of the propellant $V_{max}$=maximum attainable velocity of the propellant $T_m$=time for the propellant to reach the center of the magnetic field of the coil F=magnetic force on the propellant $\tau_o$=time when the magnetic field is initially applied to the propellant $\tau_x$=time when the magnetic field is removed (dissipated)

$\tau = \tau_x - \tau_o$.

* * * * *